US006877561B2

(12) United States Patent
Richard et al.

(10) Patent No.: US 6,877,561 B2
(45) Date of Patent: Apr. 12, 2005

(54) GRAVEL PACKING METHOD USING VIBRATION AND HYDRAULIC FRACTURING

(75) Inventors: Bennett M. Richard, Kingwood, TX (US); Chad J. Abadie, Lafayette, LA (US); Donald C. Gossen, New Iberia, LA (US); John T. Broome, The Woodlands, TX (US); Kendall R. Dyson, St. Martinville, LA (US)

(73) Assignee: Baker Hughes Incorporated, Houston, TX (US)

( * ) Notice: Subject to any disclaimer, the term of this patent is extended or adjusted under 35 U.S.C. 154(b) by 12 days.

(21) Appl. No.: 10/281,622

(22) Filed: Oct. 28, 2002

(65) Prior Publication Data

US 2004/0211560 A1 Oct. 28, 2004

(51) Int. Cl.[7] ..... E21B 43/08
(52) U.S. Cl. ..... 166/278; 166/51
(58) Field of Search ..... 166/278, 51

(56) References Cited

U.S. PATENT DOCUMENTS

| | | | | |
|---|---|---|---|---|
| 3,113,621 A | | 12/1963 | Krueger et al. | |
| 3,933,205 A | | 1/1976 | Kiel | |
| 4,550,779 A | | 11/1985 | Zakiewicz | |
| 5,036,920 A | | 8/1991 | Cornette et al. | |
| 5,076,355 A | * | 12/1991 | Donovan et al. | 166/55.1 |
| 5,228,510 A | | 7/1993 | Jennings, Jr. et al. | |
| RE34,451 E | | 11/1993 | Donovan et al. | |
| 5,273,114 A | * | 12/1993 | Wicks, III et al. | 166/278 |
| 5,361,830 A | * | 11/1994 | Wicks, III et al. | 166/51 |
| 5,366,009 A | * | 11/1994 | Cornette et al. | 166/51 |
| 5,394,938 A | * | 3/1995 | Cornette et al. | 166/51 |
| 5,411,090 A | * | 5/1995 | Cornette et al. | 166/278 |
| 5,598,891 A | | 2/1997 | Snider et al. | |
| 5,617,921 A | | 4/1997 | Schmidt et al. | |
| 5,669,448 A | | 9/1997 | Minthorn et al. | |
| 5,845,712 A | | 12/1998 | Griffith, Jr. | |
| 6,230,802 B1 | | 5/2001 | Duhon | |

FOREIGN PATENT DOCUMENTS

| | | |
|---|---|---|
| SU | 1120090 A | 10/1984 |
| WO | WO 02/06593 A1 | 1/2002 |

* cited by examiner

*Primary Examiner*—William Neuder
(74) *Attorney, Agent, or Firm*—Steve Rosenblatt

(57) ABSTRACT

A gravel packing method combining fracturing is described. A gun having an exterior auger is used to perforate. With the gun in place, the gravel is positioned around it and the formation is fractured, pushing the gravel into the fractures. The gun is rotated out of the gravel using the auger. A screen with an external auger is run in and rotated into the packed gravel in the wellbore while being vibrated at the same time. After the screen is advanced into position the vibrator is removed and a flapper closes to minimize fluid loss into the formation. A production string and packer are tagged into the screen and production begins.

17 Claims, 2 Drawing Sheets

GRAVEL PACKING METHOD USING VIBRATION AND HYDRAULIC FRACTURING

FIELD OF THE INVENTION

The field of the invention is gravel packing a wellbore and more particularly using fracturing to deliver the gravel into the formation and vibration to insert a production screen.

BACKGROUND OF THE INVENTION

In completing wells having production or injection zones which lie adjacent incompetent subterranean formations (i.e. formations formed of an unconsolidated matrix such as loose sandstone or the like) or which lie adjacent formations which have been hydraulically-fractured and propped, serious consideration must be given to the sand control problems which will almost certainly arise during the operational life of the well. These problems arise when large volumes of sand and/or other particulate material (e.g. backflow of proppants from a hydraulically-fractured formation) dislodge from the formation and become entrained in the formation fluids and are produced therewith into the wellbore. These produced materials are highly detrimental to the operation of the well and routinely cause erosion, plugging, etc. of the well equipment, which, in turn, leads to high maintenance costs, and considerable downtime of the well.

While many techniques have been proposed for controlling sand production in a well, probably the most widely-used is one which is generically known as "gravel packing". Basically, a gravel pack completion is one wherein a fluid-permeable liner (e.g. screen, perforated liner, slotted liner, pre-packed screens, combinations thereof, or the like) is positioned within the wellbore (open or cased) adjacent the incompetent or fractured zone and is subsequently surrounded by aggregate or particulate material through some means of circulation (collectively called "gravel" or, more generally, "proppant"). As known in the art, the gravel particles are sized to block or filter out the formation particulates which may become entrained in the produced fluids while the openings in the liner are sized to block the gravel from flowing into the liner. This two-stage filtration system is commonly known as a "gravel pack".

There are two basic, well-known techniques for installing a typical gravel pack completion in a wellbore. A first of these techniques involves positioning the fluid-permeable liner in the wellbore before placing the gravel around the liner to form the gravel pack. The other technique involves placing the gravel in the wellbore first and then driving, rotating, or washing the liner into the gravel to form the gravel pack.

While both of these techniques have been widely used, both require the circulation of fluid during installation. For example, where the liner is positioned first in the wellbore, a slurry of gravel and a carrier fluid may be pumped down and out through a "cross-over" sub into the annulus formed between the liner and the cased wall (cased hole) or the bore wall (open hole). The openings in the liner allows only the carrier fluid to flow from the annulus into the liner while the gravel is strained from the fluid and is deposited within the annulus to form the gravel pack. The gravel can also be placed by flowing the gravel directly into the annulus around the liner from the surface or through open-ended tubulars, which extend down the wellbore.

Where the gravel is placed in the wellbore first, the liner is lowered on a workstring and is washed or driven into place while fluid is being pumped down the workstring and out the bottom of the liner. This circulating fluid (i.e. jetting action) is necessary to "fluidize" the pre-positioned or preset gravel so that the liner can be lowered into and through the gravel to form the gravel pack. Unfortunately, since the fluid flows through the workstring, the pumping must be stopped each time an additional stand of workstring must be added to lower the liner further into the gravel. While the pumping is stopped, the gravel settles and in many instances, cannot be adequately "re-fluidized" upon the resumption of pumping to allow any deeper placement of the liner into the gravel.

Since both techniques require the pumping and/or circulation of fluid under pressure during installation, both may experience severe fluid loss problems, especially when used to complete zones adjacent formations having normal or below normal pressures or pressures which are below the hydrostatic pressure of the completion fluids in the wellbore. For example, in placing gravel around a preset liner, the loss of expensive completion fluids to an underpressured formation (i.e. formation having a pressure less than the fluid pressure in the wellbore) can be excessive. The use of known loss-circulation materials in the gravel slurry is limited since such materials severely hinder the placement of the gravel around the liner. Where the gravel is positioned first, the fluid losses during the high pressure jetting required to "fluidize" the preset gravel also can be excessive. In both cases, these fluid losses not only result in increased costs due to the loss of the expensive completion fluids, themselves, but also contribute to severe formation damage in many cases thereby reducing the productivity and/or operational life of the completed well.

To counteract the above-described problems, U.S. Pat. No. 5,036,920 disclosed a screen with an external auger to allow the gravel to be deposited without circulation, so as to minimize fluid loss. Thereafter, the screen was rotated into the gravel to form the gravel pack without the need to circulate to fluidize the gravel. Augers have been used on perforating guns to facilitate extracting them after they have been shot and debris collects in the annular space surrounding them. This use of an auger on a perforating gun is shown in U.S. Pat. No. Re. 34,451. In this reference, the well is brought in to remove debris from perforating and then gravel is spotted in position and then the slurry is pumped into the perforations. Another technique is to deposit the gravel after placing the screen and then use occasional vibration to evenly distribute the deposited gravel in the annulus.

One technique of gravel deposition and dispersal into the perforations is to use fracturing. The gravel is dispersed using high pressure and flow rates. Hydraulic fracturing techniques of various types are described in several U.S. Patents, such as: U.S. Pat. Nos. 3,933,205; 4,550,779; 5,228,510; 5,617,921; 5,598,891 and 5,669,448. Various sensors can be employed to monitor the fracture packing operation, as described in WO 02/06593 A1.

More recently deposition of gravel by fracturing has become more prevalent for exclusion of produced sands in areas prone to sand production. The reason for this shift in technique is the higher productivity realized with the fracturing technique. Fracturing effectively penetrates to hundreds of feet into the formation to bypass previously induced damage mechanisms. However, fracturing has brought on other problems such as crossover tool erosion, casing erosion, screen erosion, stuck crossover tools, downhole real time pressure monitoring problems and fluid losses to the formation.

The method of the present invention mitigates at least some of these prior problems. The gravel is placed in position after under-balanced perforating. Fracturing is done with the gun in position and the gun is subsequently extracted. The screen is inserted into the preset gravel that has been pushed into the perforations and augered into the gravel with the help of vibration. Subsequently, the vibrator is removed and a production packer is tagged into the screen for subsequent production. These and other aspects of the present invention will be more apparent to those skilled in the art from a review of the description of the preferred embodiment, which appears below.

SUMMARY OF THE INVENTION

A gravel packing method combining fracturing, using flights, rotation and vibration is described. A gun having an exterior auger is used to perforate. With the gun in place, the gravel is positioned around it and the formation is fractured, pushing the gravel into the fractures. The gun is rotated out of the gravel pack using left hand auger flights. A screen with an external auger is run in and rotated into the packed gravel in the wellbore while being vibrated at the same time. After the screen is advanced into position the vibrator is removed and a flapper closes to minimize fluid loss into the formation. A production string and packer are tagged into the screen and production begins.

DETAILED DESCRIPTION OF THE PREFERRED EMBODIMENT

Figures 1, 2, 3, 4, 5, 6:
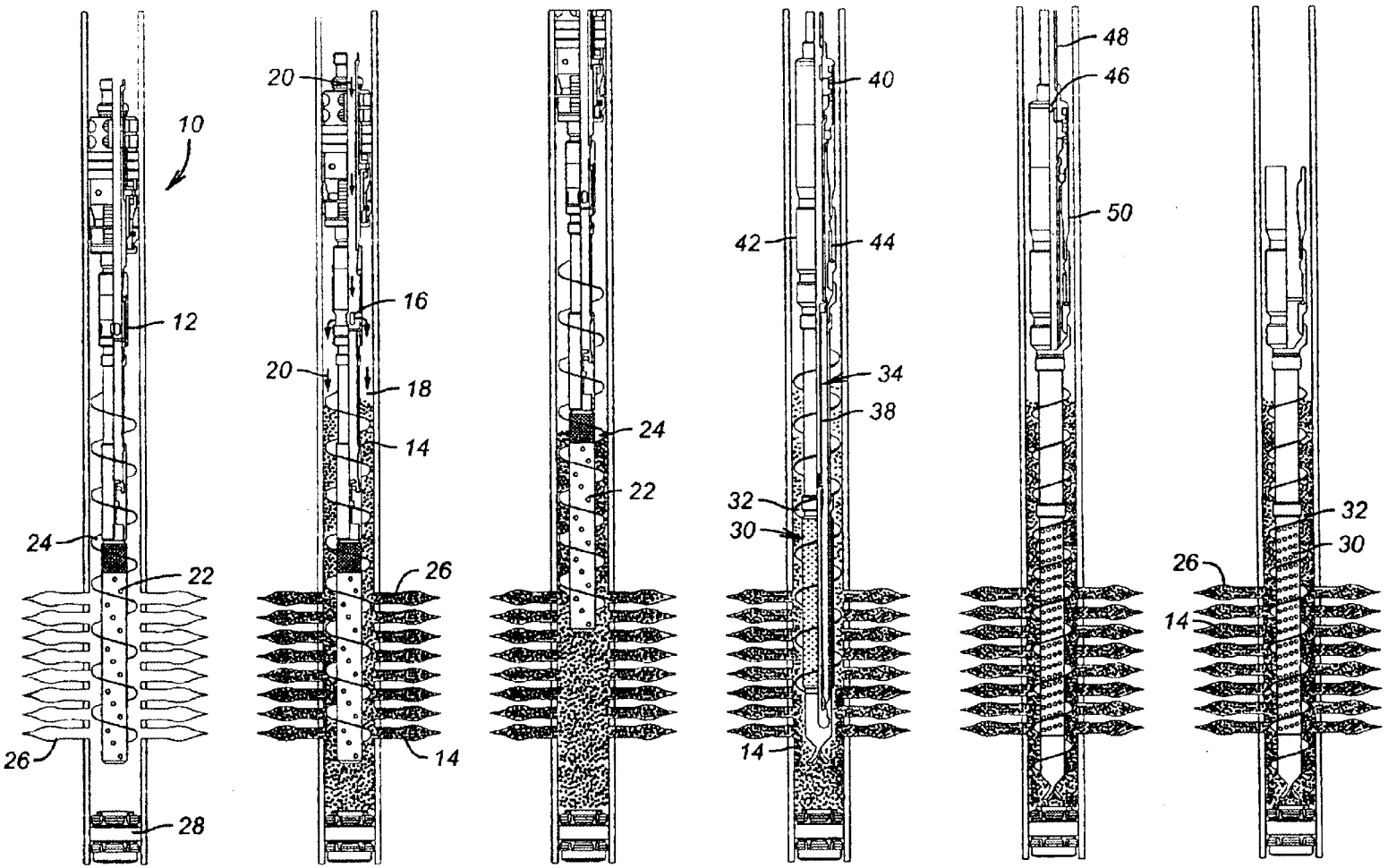
FIG. 1 is a section view showing the gun with auger run into position.
FIG. 2 is the view of FIG. 1 showing the gun shot off and the gravel being delivered with the fracturing fluid.
FIG. 3 is the view of FIG. 2 after the fracturing and showing the gun being removed by rotation.
FIG. 4 is the view of FIG. 3 showing the auger screen being inserted in the gravel with vibration.
FIG. 5 is the view of FIG. 4 showing the release of the running string from the screen.
FIG. 6 shows the screen in position to receive the production string and isolation packer.

FIG. 1 illustrates an isolation packer 10 delivered on a tubing string (not shown). Below the packer is a crossover 12 that permits gravel 14 to exit ports 16 to enter annulus 18 as shown in FIG. 2. Arrows 20 represent the flow of gravel and fracturing fluid into annulus 18, which occurs after the gun 22, is in the desired position shown in FIG. 1. Gun 22 has an exterior auger 24 to facilitate its extraction after being shot and creating perforations 26. An isolation packer 28 may be set below the perforating gun 22.

FIG. 2 shows the gravel 14 forced into the perforations 26 as part of the fracturing process initiated from the surface with the introduction of pressurized fluid and the gravel 14. Fracturing begins after well fluids are first reversed out. As a result of the fracturing, the gravel 14 is forced into the perforations 26 to hold them open and promote production. The gravel 14 also reduces sand production from the formation. At the end of the fracturing operation when the gravel 14 is deposited in the perforations 26, as desired, the gun 22 is removed preferably by right hand rotation to help further pack the gravel 14 in the perforations 26. The rotating flights of auger 24 give an exit push to the gun 22 while at the same time the reaction force helps to compress the gravel 14 further into the perforations 26.

With the gun 22 removed, a screen 30 having an auger 32 that extends over a screen portion 34 and a blank portion 36 is inserted. A removable vibrator 38 is connected to the hook up nipple 40. The hook up nipple is rotationally locked to the knock out isolation valve 42. Inside valve 42 is a flapper 44, which closes after removal of the vibrator 38. As shown in FIG. 4, the screen 30 is preferably rotated to the right to allow auger 32 to assist the screen 30 in penetrating the gravel 14. The vibrator 38 is activated continuously or intermittently, as needed to help in the advancement of the screen 30. Vibrator assembly 38 holds flapper 44 open during this operation. The entire assembly shown in FIG. 4 is rotated from the surface to advance screen 30 using auger 32 in conjunction with vibration from the vibrator 38. Vibrator 38 may be actuated by circulation, reverse circulation, or a locally provided power source. Any type of known vibrator can be used. The more contact with screen 30 that can be arranged with vibrator 38 and the higher the amplitude of the vibration, the easier will it be to insert the screen 30 into the gravel 14 which has been previously packed during the fracturing operation.

FIG. 5 shows dropping a ball 46 and pressuring up on string 48 to release from receptacle 50. The vibrator 38 is removed with the string 48 and flapper 44 falls shut. Closing flapper 44 reduces fluid loss from above into the formation. In FIG. 6 the screen 30 is ready to receive a production string and packer (not shown) so that production can begin.

Those skilled in the art will recognize the advantages of the disclosed method. The erosion risk is reduced as the fracturing is completed with the gun 22 still in position and before the screen 30 is inserted. Cleaner perforations are possible and the possibility of bridging and voids in the gravel 14 are reduced. The auger action in removing the gun 22 and inserting the screen 30 help to evenly distribute the gravel 14 in the annulus 18 and mechanically drive proppant into the perforations. The presence of the augers 24 and 32 allow respectively for removal of the gun 22 or the screen 30, should that at any time become necessary. The need to pump pills into the formation, which can damage it and fill perforations with undesirable materials, are also minimized when fracturing the formation with the perforating guns across the production interval. With all perforations open to flow, out of phase perforations from the fracture wings can also be packed either during the pumping process or mechanically during the gun removal.

Figure 7:
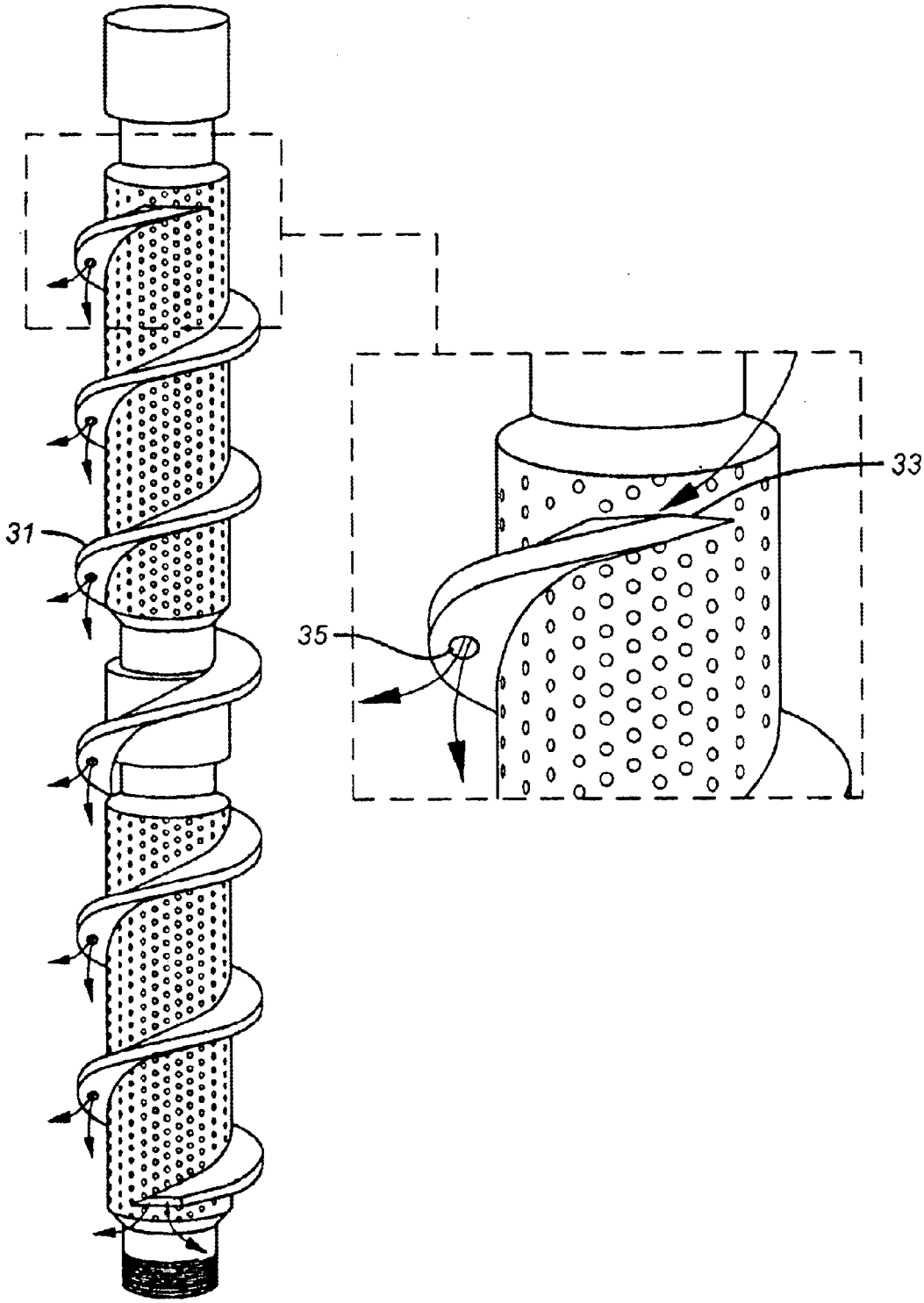
FIG. 7 illustrates the use of hollow flights that act as an auger and as an alternative flow path or paths to conduct gravel around bridges.

The augers such as 24 and 32 can be segmented or continuous and can have a constant pitch or variation in pitch along its length. The flights may be enclosed or open in various locations either above or below or both so as to act as a shunt tube to eliminate bridging by giving the gravel alternate paths to redistribute it when being deposited under pressure. FIG. 7 illustrates hollow flights 31 that have an opening 33 in the top and multiple bottom openings 35 at different elevations to discharge gravel that has entered opening 33. There can be many inlet openings such as 33. This can be accomplished by making the flights 31 discontinuous. The pitch and diameter of flights 31 can vary. The direction of rotation and the speed can be varied. The augers can be rotated in series in opposed directions to facilitate insertion of the screen 30 or removal of the gun 22. Rather than using flights 31, the augers can comprise a plurality of extending rods that protrude radially and create a similar effect to assist insertion of screen 30 or removal of gun 22.

The foregoing disclosure and description of the invention are illustrative and explanatory thereof, and various changes in the size, shape and materials, as well as in the details of the illustrated construction, may be made without departing from the invention.

We claim:

1. A method of wellbore completion, comprising:

placing proppant into perforations and the wellbore with fluid that fractures the formation surrounding the wellbore;

inserting a screen into the proppant previously placed into the wellbore;

vibrating said screen to facilitate its insertion into said proppant;

rotating said screen while vibrating it to facilitate its insertion.

2. The method of claim 1, further comprising:

providing an auger on the exterior of said screen to facilitate insertion from said rotation.

3. The method of claim 2, further comprising:

using a plurality of extending rods as said auger.

4. The method of claim 1, further comprising:

using a vibrator to vibrate said screen;

operating said vibrator with one of circulation, reverse circulation and a locally mounted power supply.

5. A method of well completion, comprising:

placing proppant into perforations and the wellbore with fluid that fractures the formation surrounding the wellbore;

inserting a screen into proppant previously placed into the wellbore;

vibrating said screen to facilitate its insertion into said proppant;

using a vibrator to vibrate said screen;

delivering said vibrator with said screen in a single trip;

holding open a fluid loss control valve with said vibrator.

6. The method of claim 1, further comprising:

vibrating said screen continuously during said inserting.

7. The method of claim 1, further comprising:

vibrating said screen intermittently during said insertion.

8. The method of claim 1, further comprising:

using a vibrator to vibrate said screen;

removing said vibrator from said screen after insertion of said screen.

9. The method of claim 1, further comprising:

using a vibrator to vibrate said screen;

delivering said vibrator with said screen in a single trip.

10. The method of claim 5, further comprising:

removing said vibrator from said screen after insertion of said screen; and closing said fluid loss control valve by said removing of the vibrator.

11. The method of claim 10, further comprising:

providing a flapper valve that closes after removal of the vibrator, as the fluid loss control valve.

12. The method of claim 1, further comprising:

positioning a perforating gun in a wellbore;

shooting off the gun to create perforations in the wellbore;

forcing the proppant though a packer and a crossover to forcibly deposit said proppant in an annular space in the wellbore around said gun and into the formation.

13. The method of claim 2, further comprising:

rotating the screen in at least one direction while vibrating it.

14. The method of claim 13, further comprising:

providing a plurality of flights spiraling around the outside of the screen in at least one pitch as said auger.

15. A method of well completion, comprising:

placing proppant into perforations and the wellbore with fluid that fractures the formation surrounding the wellbore;

inserting a screen into proppant previously placed into the wellbore;

vibrating said screen to facilitate its insertion into said proppant;

rotating said screen to facilitate its insertion;

providing an auger on the exterior of said screen to facilitate insertion from said rotation;

rotating the screen in at least one direction while vibrating it;

providing a plurality of flights spiraling around the outside of the screen in at least one pitch as said auger;

substantially enclosing said flights while leaving openings in them for gravel entry or exit; and using said openings to redistribute gravel.

16. The method of claim 10, further comprising:

tagging a production string and packer to said screen after removal of said vibrator.

17. The method of claim 1, further comprising:

positioning a perforating gun in a wellbore;

shooting off the gun to create perforations in the wellbore;

providing an augur on said gun; and rotating said gun is at least one direction while extracting it.

* * * * *